United States Patent [19]

Grieco et al.

[11] 4,311,257

[45] Jan. 19, 1982

[54] APPARATUS FOR DISPENSING FOOD STUFFS FROM A SANITIZED CONTAINER WHILE MAINTAINING THE SANITARY INTEGRITY THEREOF

[75] Inventors: Frank G. Grieco, 42637 R.D. 114, Dinuba, Calif. 93618; Vito R. Lovero, Dinuba, Calif.

[73] Assignee: Frank G. Grieco, Sultana, Calif.

[21] Appl. No.: 51,707

[22] Filed: Jun. 25, 1979

[51] Int. Cl.[3] ..... B65D 25/38

[52] U.S. Cl. ..... 222/387; 222/494

[58] Field of Search ..... 222/322, 387, 494; 221/267

[56] References Cited

U.S. PATENT DOCUMENTS

| | | | |
|---|---|---|---|
| 522,693 | 7/1894 | McLaughlin | 222/322 |
| 1,468,152 | 9/1923 | Hemstreet | 222/322 |
| 2,555,907 | 6/1951 | Venard | 222/494 |
| 2,563,251 | 8/1951 | Lanahan | 222/387 X |

*Primary Examiner*—F. J. Bartuska

*Attorney, Agent, or Firm*—Dennis B. Haase

[57] ABSTRACT

The present invention pertains generally to the dispensing of dry, typically unwrapped, food stuffs such as nuts, candies, and other food products from a container while maintaining the sanitary integrity thereof. More particularly, the invention pertains to improved dispensing apparatus comprising a raking device which permits the user to urge food stuffs within a sanitary container through a flexible seal where they are dispensed through a snout having a nonaligned aperture to prevent inadvertent entry of foreign matter into the sanitized container.

6 Claims, 3 Drawing Figures

APPARATUS FOR DISPENSING FOOD STUFFS FROM A SANITIZED CONTAINER WHILE MAINTAINING THE SANITARY INTEGRITY THEREOF

BACKGROUND OF THE INVENTION

Since the advent of the general store, candies and nuts have been dispensed from wooden barrels and glass jars. Typically such food stuffs are unwrapped not only because of the cost of individual wrapping, but because it was generally believed that the hard surface of the food stuff prevents its contamination by persons reaching in and scooping out a handfull, or by virtue of other casual entry into the container by foreign matter. Since those early days, however, government directives have been issued in ever increasing numbers with regard to standards for maintenance of the sanitary integrity of such food stuffs. Currently, the dispensing of dried fruits and nuts, sunflower seeds, and other food stuffs which are capable of being stored in bulk in containers is heavily regulated and those regulations, as well as good common sense, dictate that the containers be relatively free of contamination in use.

There have been numerous candy dispensing devices, not the least of which is the common gum ball machine, but such devices do not meet the needs of a bulk dispenser. There have also been numerous efforts at developing a liquid dispensing container having limited access to minimize contamination but, again, none of these devices serve the need of the bulk dry foods dispenser. The present invention, as will be evidenced by the detailed disclosure, meets that need.

DESCRIPTION OF THE PREFERRED EMBODIMENT

Figure 1:
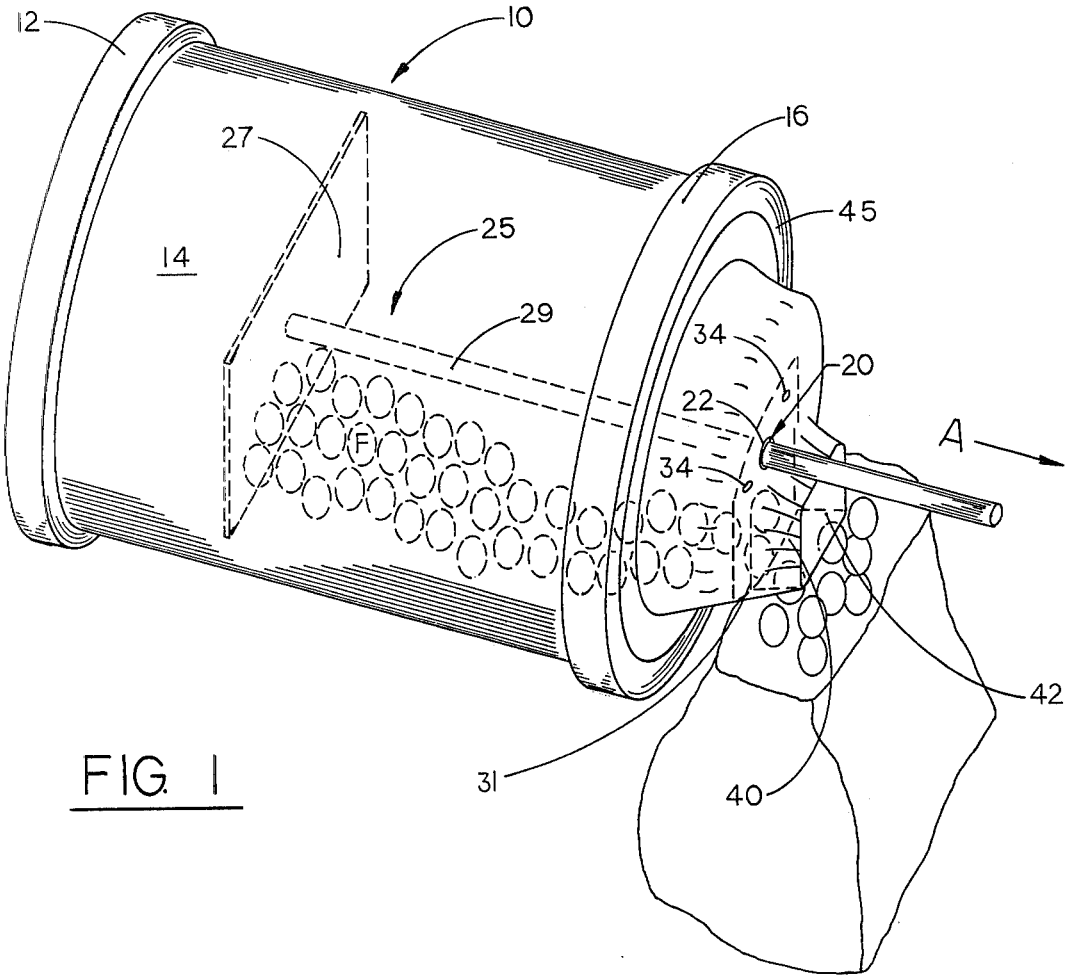
FIG. 1 is a pictorial illustration of the container having the dispensing means of the present invention.

With reference now to the drawing, and particularly FIG. 1 thereof, there is illustrated, in perspective, a sealed and sanitized bulk food dispensing container 10. The container comprises a base 12 and a barrel or cylinder 14 which is, in the present instance, constructed of an approved plastic material capable of being readily sanitized. A lid 16 fits tightly about the barrel and functions in conjunction with the base to add strength and stability to the barrel, and, of course, to enclose the container.

The invention, in its essential aspects, provides apparatus for dispensing food stuffs from the container, while at the same time maintaining the sanitary integrity of the food stuffs within the container. This is accomplished, in accordance with the invention, by providing a relatively centrally disposed orifice 20 in the lid which is capable of receiving a teflon or other seal 22. A food stuff gathering and moving device, such as a rake, 25 is provided having a blade or scoop member 27, depending from a handle 29. The handle is of such dimension as to protrude through the orifice 20 and to be engaged by the seal 22 in order to permit the rake to be moved axially of the container while preventing the entry of foreign matter into the container proper through the orifice.

Figure 3:
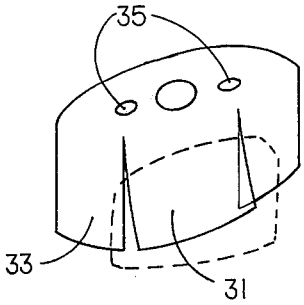
FIG. 3 is a pictorial representation of sheet 33 showing details of construction thereof.

In order that food stuffs within the container may be dispensed, a food dispensing opening 31 of suitable size is located beneath the orifice 20. In order, in accordance with the invention, to provide optimum sealing of that opening when not in use, a flexible seal comprising, in the illustrated case, a sheet 33 of flexible vinyl material capable of being sanitized is disposed over the opening where it is fastened to the lid by fasteners 35. The seal is normally seated against the surface of the lid to seal the opening, but is capable of being flexed outwardly as best seen in FIG. 3 and as the rake 25 is moved in direction of the arrow A, food stuffs indicated simply as F within the container, are moved towards the opening 31. As the rake continues to move in the direction A, the food stuffs move against and force the flexible seal 33 outwardly, permitting them to be dispensed from the container. When the pressure of the rake is relieved, of course, the seal returns to its initial seated position, covering the opening 31.

The seal 33, as is now apparent, protects the opening 31 from inadvertent incursion of foreign matter into the sanitized container. However, it alone would not prevent intentional incursion such as by a child who wishes to reach into the container to obtain some of the contents thereof. In order to discourage such temptations, the invention further contemplates the provision of a second dispensing opening of such size and location as to inhibit intentional entry to the container. To this end, a snout 40 which may be formed integrally with the lid 16 is provided. The snout is formed with an opening 42, which is misaligned or unaligned with the opening 31 and is shown here as opening downwardly or transverse to the axis of the container. The opening 42 is of sufficient size to permit the free passage of food stuffs from the container, while at the same time is small enough, and due to the lack of alignment with the opening 31, sufficient to thwart any efforts by hands to enter into the sanitized container.

Figure 2:
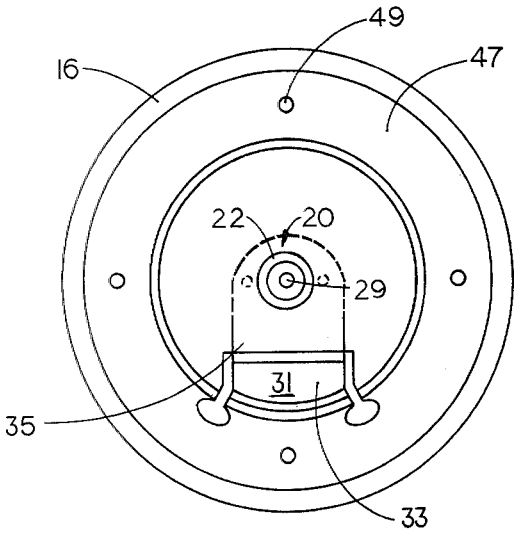
FIG. 2 is a rear elevation of the lid portion of the dispensing apparatus in FIG. 1.

As best seen in FIG. 2, the invention further contemplates that the lid 16 may be constructed to include a ring member 45 on to which may be fastened a face plate 47 such as by fasteners 49. Such an arrangement permits the face plate, which is that portion of the container which receives the most activity and is most likely to become contaminated or worn, to be removed, resanitized, repaired or replaced from time to time as the seal 33 or other parts become worn or damaged.

From the foregoing, it will be apparent that there is provided a sanitized container and apparatus for dispensing food stuffs therefrom without adversely affecting the sanitary integrity of the remaining food stuffs within the container.

Having now described the preferred embodiment of our invention, we claim:

1. Apparatus for dispensing dry food stuffs from a container while maintaining the sanitary integrity of the remainder thereof comprising a container having a base member, a cylindrical barrel, and a lid an orifice formed in the lid of said container means defining an opening in the wall of the lid of said container beneath said orifice means passing through said orifice, movable to urge food stuffs in said container to and through said opening, means defining a flexible seal comprising a relatively thin sheet of material connected to the exterior of said lid and disposed across said opening, and in sealing engagement with said lid about said opening to protect said opening against incursion of foreign matter into said container, means defining a snout protruding outwardly from said container about said opening, a second opening in said snout disposed out of alignment with said opening in said container to protect said opening against inadvertent entry of foreign matter into said container, said snout being disposed beneath said orifice and said means passing therethrough.

2. The apparatus of claim 1 wherein said dispensing means comprises a rake having a handle moveably disposed through said orifice, and further including a seal in said orifice and fitted about said handle, said rake including a depending portion adapted to engage food stuffs in said container.

3. The apparatus of claim 1 wherein said dispensing means comprises a rake having a handle moveably disposed through said orifice, and further including a seal in said orifice and fitted about said handle, said rake including a depending portion adapted to engage food stuffs in said container.

4. The apparatus of claim 1 wherein said flexible seal comprises a sanitizable flexible plastic sheet secured at one end thereof so as to normally repose in sealing relation about said opening and flexible to permit food stuffs to be dispensed through said opening.

5. The apparatus of claim 3 wherein said flexible seal comprises a sanitizable flexible plastic sheet secured at one end thereof so as to normally repose in sealing relation about said opening and flexible to permit food stuffs to be dispensed through said opening.

6. The apparatus of claim 4 wherein said flexible seal is movable against the upper extremity of said opening in said lid and outwardly against the surface of said snout to permit unrestricted passage of dry food stuffs from within said container.

* * * * *